US005343142A

United States Patent [19]

Sasaki et al.

[11] Patent Number: 5,343,142

[45] Date of Patent: Aug. 30, 1994

[54] SHEET SIZE DETECTION DEVICE

[75] Inventors: Toshinori Sasaki; Akira Kanazawa; Kenji Hara; Tomoo Fukao; Masahiko Ishizuka; Masatomo Yamada; Naoto Sugimura; Michiaki Yoshihara, all of Saitama, Japan

[73] Assignee: Fuji Xerox Co., Ltd., Tokyo, Japan

[21] Appl. No.: 960,053

[22] Filed: Oct. 14, 1992

[30] Foreign Application Priority Data

Oct. 15, 1991 [JP] Japan ..... 3-266360

[51] Int. Cl.[5] ..... G01N 27/04; G01R 27/02

[52] U.S. Cl. ..... 324/71.1; 324/691; 324/714; 324/716

[58] Field of Search ..... 324/691, 699, 714, 716, 324/71.1; 358/406

[56] References Cited

U.S. PATENT DOCUMENTS

| | | | |
|---|---|---|---|
| 2,856,582 | 10/1958 | Anderson | 324/71.1 |
| 2,902,765 | 9/1959 | Chater | 324/71.1 |
| 4,994,752 | 2/1991 | Hata | 324/714 |
| 5,070,622 | 12/1991 | Butzin et al. | 324/716 X |

FOREIGN PATENT DOCUMENTS 63-185730 8/1988 Japan .

*Primary Examiner*—Kenneth A. Wieder
*Assistant Examiner*—Glenn W. Brown
*Attorney, Agent, or Firm*—Finnegan, Henderson, Farabow, Garrett & Dunner

[57] ABSTRACT

A sheet size detection device for detecting a size of sheets which are held in a cassette body comprises a first guide member for defining the position of the sheets which are held in the body of the cassette, in a first direction of the sheets, the first guide member being movable in accordance with the size of sheets, a second guide member for defining the position of the sheets, in a second direction of the sheets, the second direction being orthogonal to the first direction, the second guide member being movable in accordance with the size of sheets, a first arm having a first resistor and movable with the first guide member, a second arm having a second resistor and movable with the second guide member, the first and second resistors constituting a variable resistor, and a size detector for detecting the size of the sheets on the basis of the resistance value of the variable resistor.

5 Claims, 3 Drawing Sheets

SHEET SIZE DETECTION DEVICE

BACKGROUND OF THE INVENTION

1. Field of the Invention

This invention relates to a sheet size detection device for detecting the size of sheets held in the body of a cassette which can cope with two or more sheet sizes, and more particularly to a sheet size detection device which is applicable to a sheet feeder of an image forming apparatus such as a copier, a printer or a facsimile apparatus.

2. Related Art

In an image forming apparatus such as a copier, generally, a sheet feed cassette which is detachably mounted on the main body of the apparatus is used as a sheet feeder. Such sheet feed cassettes include an exclusive cassette which can accommodate only standard sheets of a predetermined one of the sizes of JIS A series such as A3 or A4, or JIS B series such as B4 or B5, and a universal cassette and can cope with two or more sheet sizes.

When such a universal cassette is used, it is required to indicate the sizes of sheets with which the cassette can cope. Moreover, when an automatic magnification copy operation is to be done, it is necessary to display on the main body of a copier the size or direction of sheets which are held in a universal cassette. An example of a sheet size detection device which detects the size of sheets held in such a cassette is disclosed in Japanese Laid-Open Patent Publication No. Sho 63-185730 entitled "Sheet supply cassette".

In this sheet size detection device, a transverse guide member and feeding-direction guide member which respectively define the position of sheets in the transverse and longitudinal directions are moved, thereby causing sliding contacts of variable resistors corresponding to the members, to slide. On the basis of the variations in resistance, the size of the sheets can be detected.

In this conventional sheet size detection device, however, current levels which vary depending on the position of the feeding-direction guide member and that of the transverse guide member must be independently measured in the longitudinal direction of the sheets (the feeding direction of the sheets) and the transverse direction, so that a control circuit provided in the main body of the copier judges the size of the sheets on the basis of the measured current levels. This brings problems in that the circuit configuration is complex, the control circuit is liable to malfunction, and the costs of parts are high. When the detection device is constructed so as to detect larger sheet sizes, furthermore, a contact failure is liable to occur in the wiring portions, thereby causing a further problem in that the reliability of the detection device is reduced.

SUMMARY OF THE INVENTION

In view of the above-mentioned problems, an object of the invention is to provide a sheet size detection device which can be constructed in a simplified structure, manufactured with a reduced cost, and operated with: a reduced number of malfunctions, accurate detection of the size of sheets, and a high reliability.

The above object has been achieved by a sheet size detection device which comprises: a first guide member for defining the position of sheets which are held in the body of a cassette, in a first direction of the sheets, said first guide member being movable in accordance with the size of sheets; a second guide member for defining the position of said sheets, in a second direction of the sheets, said second direction being orthogonal to said first direction, said second guide member being movable in accordance with the size of sheets; a first arm having a first resistor and movable with said first guide member; a second arm having a second resistor and movable with said second guide member, said first and second resistors constituting a variable resistor; and size detection means for detecting the size of the sheets on the basis of the resistance value of said variable resistor.

In the sheet size detection device thus organized, the first and second guide members are moved to a respective predetermined position in accordance with the size of sheets which are held in the cassette body, and this movement of the guide members causes the first and second arms to move so as to change the resistance value of the variable resistor which is constituted by the first and second resistors.

According to the sheet size detection device of the invention, therefore, the size of sheets can be output in the form of the continuous change of the resistance value, and the detectable sizes of sheets and the range of its tolerance can be finely set.

Alternatively, the sheet size detection device of the invention may be so configured that the first and second resistors are positioned at the respective center position of the first and second directions of the sheets and respectively made of materials which are different from each other in specific resistance.

According to this configuration, the sheet size detection device of the invention can easily perform not only the identification of sheets of various sizes, but also the judgment of the direction of sheets of the same size (or the discrimination between so-called longitudinal placement and transverse placement).

Alternatively, in the sheet size detection device of the invention, the first and second resistors may be respectively positioned at locations which are separated from the respective center position of the first and second directions of sheets.

In the sheet size detection device of the invention, the direction of sheets of the same size can be judged and the first and second resistors can be made of the same material.

DETAILED DESCRIPTION OF THE PREFERRED EMBODIMENTS

Preferred embodiments of the invention will be described with reference to the accompanying drawings.

Figure 6:
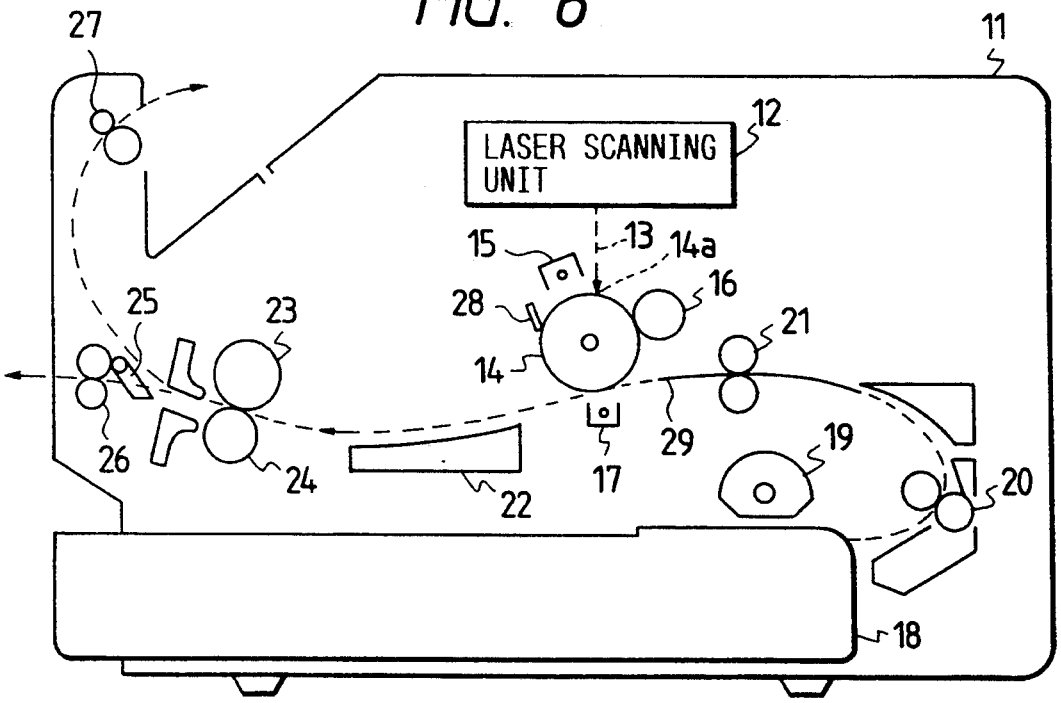
FIG. 6 is a view schematically illustrating the configuration of a laser beam printer which uses the sheet size detection device of FIG. 1.

FIG. 6 illustrates the configuration of a laser beam printer 11 which is an image forming apparatus using a sheet size detection device according to one embodiment of the invention.

The laser beam printer 11 comprises a laser scanning unit 12 from which a laser beam 13 is output. The laser beam 13 output from the laser scanning unit 12 repeatedly scans a predetermined exposure location 14*a* on a photosensitive drum 14 along the axial direction of the drum (i.e., the main scan direction). A charge corotron 15 which faces the photosensitive drum 14 is disposed at the upstream of the exposure location 14*a* and separated therefrom by a small distance, to uniformly charge the surface of the photosensitive drum 14. By irradiating the laser beam 13 onto the charged photosensitive drum 14, an electrostatic latent image which corresponds to the image information is formed on the drum surface. This electrostatic latent image is developed downstream of the exposure location 14*a*, by a developing roller 16. The toner image which has been formed as a result of the development performed by the developing roller 16 is moved with the rotation of the photosensitive drum 14 to a position which opposes a transfer corotron 17. At this position, the toner image is electrostatically transferred onto one of sheets (recording sheets) 29.

The sheets 29 are previously stacked in a sheet supply cassette 18 which is detachably mounted at the lower portion of the laser beam printer 11. The sheet supply cassette 18 is provided with a sheet size detection device which will be described later, so that the size of the sheets 29 is automatically detected.

The sheet 29 which is positioned at the uppermost layer of the stack in the sheet supply cassette 18 is sent out from the sheet supply cassette 18 by a semicircular roller 19. The sent out sheet 29 is conveyed by conveyor rollers 20 along a path indicated by a broken line, and then temporarily stopped when it reaches the forward end of resist rollers 21. Thereafter, an electromagnetic clutch (not shown) is energized so that the resist rollers 21 begin to rotate in synchronization with the rotational position of the photosensitive drum 14, thereby starting constant and stable conveyance of the sheet 29. This sheet 29 passes through the space formed between the photosensitive drum 14 and the transfer corotron 17 at a desired timing, and the toner image is transferred onto the sheet during this passage. The sheet 29 onto which the toner image has been transferred is discharged from its backside by discharging pins (not shown) which are disposed at the downstream of the transfer corotron 17, whereby the sheet is separated from the surface of the drum. The separated sheet 29 is conveyed on a conveyor path 22 of a predetermined length to relieve its tension, and then sent into a fixing device which consists of a pair of a heat roller 23 and a pressure roller 24, to be heated therein, whereby the toner image is fixed to the sheet.

A directional control guide 25 is located in the vicinity of the outlet of the fixing device. The directional control guide 25 switches the conveyance path of the sheet 29 onto which the toner image has been fixed. According to the switch operation of the directional control guide 25, the sheet 29 is allowed to straight advance so as to be discharged in a first sheet-discharge direction by sheet-discharge rollers 26, or is conveyed along a U-shaped path in the apparatus so as to be discharged by sheet-discharge rollers 27 from the upper portion of the laser beam printer 11 in a second sheet-discharge direction. The second sheet-discharge direction is substantially opposite to the first sheet-discharge direction. The toner image which has not been transferred onto the sheet 29 is removed from the surface of the drum by a cleaning device 28 which is disposed at the downstream of the transfer corotron 17.

Figure 1:
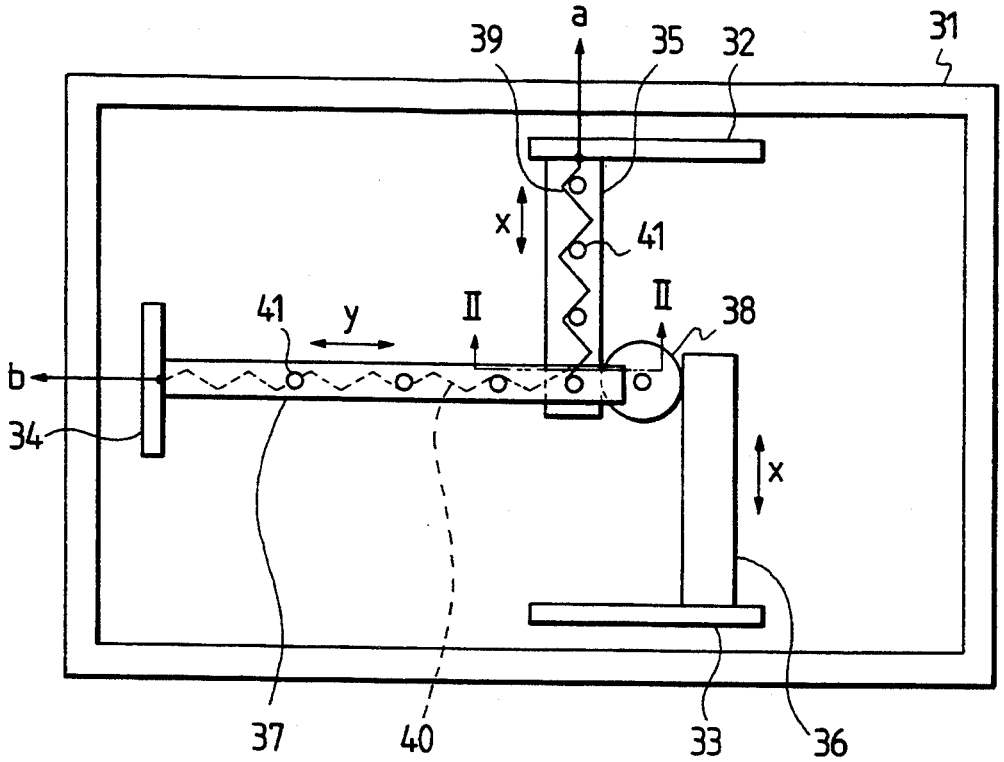
FIG. 1 is a plan view illustrating a sheet size detection device according to an embodiment of the present invention.
Figure 2:
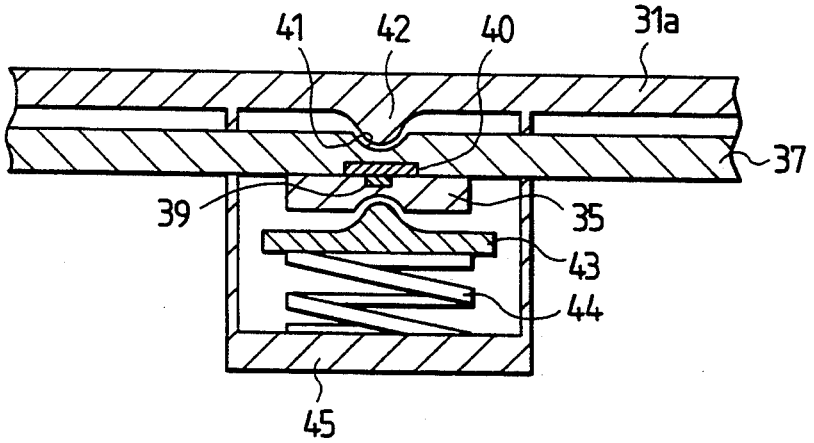
FIG. 2 is a longitudinal sectional view illustrating the sectional configuration taken along the line II—II of FIG. 1.

FIG. 1 is a plan view illustrating the internal configuration of the sheet supply cassette 18. In the figure, the bottom of the cassette body 31 is not illustrated. FIG. 2 illustrates the sectional configuration taken along the line II—II of FIG. 1 and including a bottom 31*a* of the cassette body 31.

Transverse guide members 32 and 33 and a sheet-feed direction guide member 34 are disposed in the cassette body 31. The transverse guide members 32 and 33 are respectively disposed on both sides of the center line of the transverse direction (direction x) of the cassette body 31, so as to be opposite to each other. The guide members 32 and 33 are movable in the transverse direction of the sheets 29 and along grooves (not shown) which are formed on the bottom 31*a* of the cassette body 31. The sheet-feed direction guide member 34 is movable in the longitudinal direction (direction y) of the cassette body 31 and along a groove (not shown) which elongates in a direction intersecting the above-mentioned grooves.

On the under surface of the bottom 31*a* of the cassette body 31, arms 35, 36 and 37 are unitedly connected to the transverse guide members 32 and 33 and sheet-feed direction guide member 34, respectively, so as to move with the respective guide members. A toothed portion is formed on each of the sides of the arms 35 and 36 which face to each other, and a pinion gear 38 is disposed between the arms to engage with these toothed portions. When one of the transverse guide members (e.g., the member 32) is moved in the transverse direction to accommodate to the size of the sheets 29, therefore, this linear movement is transmitted through the pinion gear 38 to the other transverse guide member (i.e., the member 33) as the reverse linear movement. The rotational axis of the pinion gear 38 is positioned on the center line of the transverse direction of the cassette body 31, and the positions of the two transverse guide members 32 and 33 are symmetrical about their respective center lines. The arm 37 elongates along the center line of the transverse direction.

Each of the arms 35–37 is made of a plate-like insulation material. On the top surface of the arm 35, a resistor 39 which is made of a conductor material such as a metal is formed to elongate along the longitudinal direction of the arm 35. In contrast, on the under surface of the arm 37, a resistor 40 which is made of a conductor material different from that of the resistor 39 is formed to elongate along the longitudinal direction of the arm 37. The resistors 39 and 40 cross each other in such a manner that they contact with each other to constitute a variable resistor 50 which will be described later. The position at which the resistors 39 and 40 contact with each other varies in accordance with movement of the arms 35 and 37 which are moved with the transverse guide member 32 and sheet-feed direction guide member 34 (i.e., depending on the size of the sheets 29), thereby changing the resistance value of the variable resistor. The one end of the resistor 39 functions as a terminal a, and that of the resistor 40 as a terminal b. When a constant voltage is applied between the terminals a and b, a current the level which corresponds to the sheet size flows.

A case 45 is unitedly fixed to the under surface of the bottom 31*a* of the cassette body 31. In the case 45, a spring 44 is disposed so that the resilience of the spring 44 is applied through a press plate 43 to the resistor 39 formed on the arm 35, thereby retaining the contact state between the resistor 39 and the resistor 40 formed on the arm 40.

A plurality of convex portions 42 are formed on the under surface of the bottom 31*a* of the cassette body 31 and at positions which correspond to the arms 35 and 37. In correspondence to the convex portions 42 of the cassette body 31, concave portions 41 are formed on the arms 35 and 37. When the convex portions 42 and concave portions 41 are engaged with each other, the transverse guide members 32 and 33 and sheet-feed direction guide member 34 are properly positioned in accordance with the size of the sheets 29.

Figure 3:
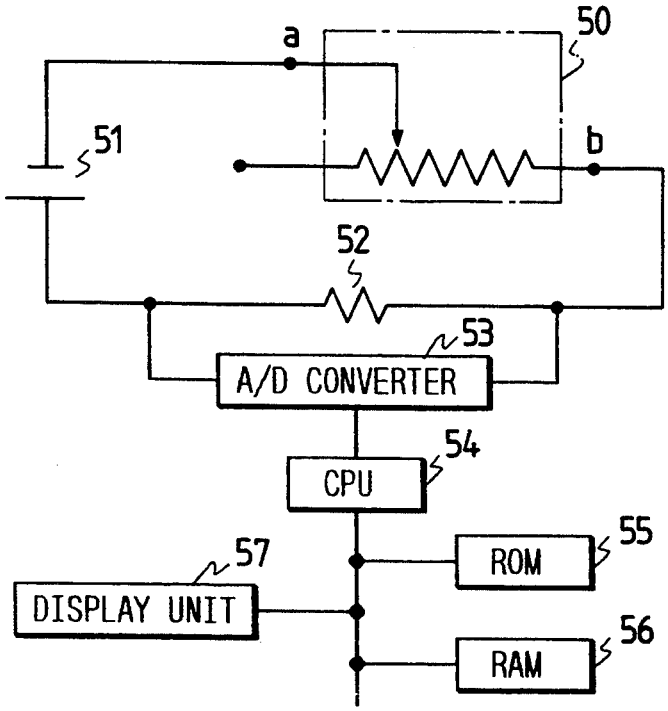
FIG. 3 is a block diagram illustrating the circuit configuration of the sheet size detection device of FIG. 1.

FIG. 3 illustrates the circuit configuration of the sheet size detection device which uses the variable resistor 50 constituted by the resistors 39 and 40.

The terminal a of the variable resistor 50 is connected to the negative terminal of a DC power supply 51, and the terminal b is connected through a fixed resistor 52 to the positive terminal of the DC power supply 51. An A/D (analog/digital) converter 53 is connected across the terminals of the fixed resistor 52. The A/D converter 53 converts the potential difference (an analog value) appearing across the fixed resistor 52 into a digital value, and the output signal of the A/D converter 53 is supplied to a CPU (central processing unit) 54. The CPU 54 controls various portions of the laser beam printer 11, and judges the size of the sheets 29 on the basis of the signal output from the A/D converter 53. A ROM (read only memory) 55, a RAM (random access memory) 56 and a display unit 57 are connected through a bus such as a data bus to the CPU 54. The ROM 55 stores programs for controlling the various portions of the laser beam printer 11, and also a program for judging the size of the sheets 29 on the basis of the signal output from the A/D converter 53. The RAM 56 is a memory for temporarily storing various data which are required in the control of the laser beam printer 11. The display unit 57 displays the size of the sheets 29 which is obtained as a result of the judgment of the CPU 54, and is mounted on an operation panel of the printer body.

Figure 4:
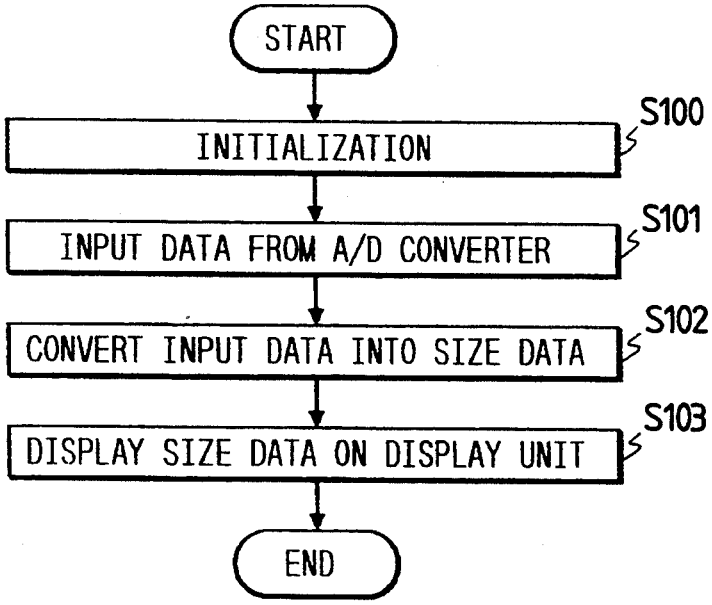
FIG. 4 is a flowchart illustrating the operation of the sheet size detection device of FIG. 1.

Next, the operation of the sheet size detection device thus organized will be described with reference to the flowchart of FIG. 4.

When the power is ON, the CPU 54 performs the initialization of various portions of the device (step S100). Then, the operator manually moves the transverse guide members 32 and 33 and sheet-feed direction guide member 34 in accordance with the size of the sheets 29 which are held in the sheet supply cassette 18, and the arms 35, 36 and 37 are moved with these members. This movement of the arms 35–37 causes the contact point between the resistors 39 and 40 to positionally change while sliding, whereby the resistance value of the variable resistor 50 shown in FIG. 3 is set in accordance with the size of the sheets 29. When a voltage from the constant-voltage power supply 51 is applied between the terminals a and b of the variable resistor 50, a current flows through the fixed resistor 52, with the result that a potential difference appears across the fixed resistor 52. This potential difference is supplied as a digital signal through the A/D converter 53 to the CPU 54. The CPU 54 which receives this signal (step S101) outputs size data indicative of the size of the sheets 29 (step S102), and controls the display unit 57 so as to display the size data (step S103).

In this way, according to the sheet size detection device of the embodiment, the position at which the resistors 39 and 40 contacts with each other can be continuously changed in a sliding manner by a simple structure. This allows the change of the size of the sheets 29 to be output as continuous variation of the resistance value of the variable resistor 50. Therefore, the detectable sizes of sheets and the range of its tolerance can be finely set, with the result that it is possible to accurately identify not only sheets of standard sizes but also those of nonstandard sizes, and also to reduce the possibility of malfunction in which the size of sheets 29 is incorrectly detected. Even if the number of sizes of sheets 29 which are to be detected is increased, the device can cope with this increased size number without changing the basic structure, and therefore it is not necessary to increase the number of wirings connecting the CPU 54 with the resistors 39 and 40, etc. This allows the manufacturing cost to be lowered, and the reliability of the device to be increased.

Figure 5:
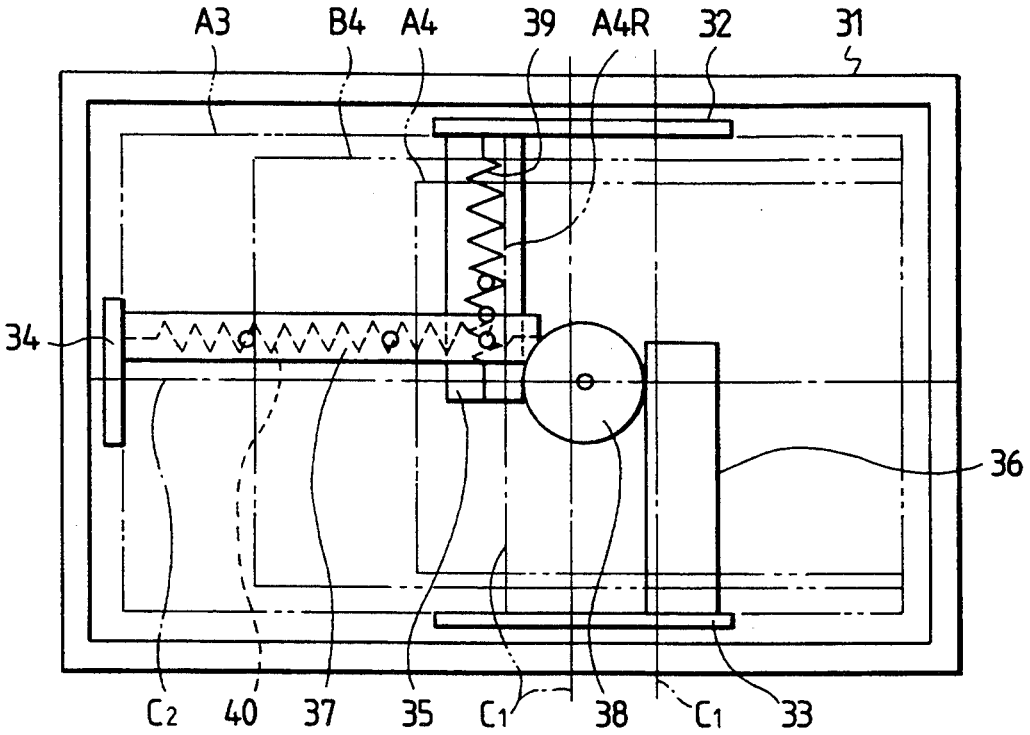
FIG. 5 is a plan view illustrating the configuration of a sheet size detection device according to another embodiment of the invention.

FIG. 5 illustrates the configuration of a sheet size detection device according to another embodiment of the invention. In FIG. 5, portions having the same configuration as those of the above-described embodiment are designated by the same reference numerals, and their description is omitted. Similar to FIG. 1, the bottom of the cassette body 31 is not illustrated also in FIG. 5.

In the sheet size detection device illustrated in FIG. 1, the resistor 40 is positioned so as to coincide with the center line of the transverse direction. If the resistors 39 and 40 are made of the same material, therefore, it is possible to detect the sheets 29 of different sizes, but not to judge the direction of the sheets 29 of the same size. More specifically, in both two cases: a case wherein sheets are stacked in the manner of longitudinal placement; and another case wherein sheets are stacked in the manner of transverse placement, the variable resistor 50 exhibits the same resistance value, and hence it is not possible to discriminate between the two cases. Accordingly, in the embodiment of FIG. 1, the material of the resistor 39 is different from that of the resistor 40, so that the device can judge the direction of the sheets 29 of the same size.

In contrast, in the sheet size detection device illustrated in FIG. 5, the positions of the arms 35, 36 and 37 are set so that the resistors 39 and 40 are respectively positioned to be separated from the center line of the transverse direction and sheet feeding direction of the sheets 29 held in the cassette body 31. In FIG. 5, the one-dot or two-dot chain lines $C_1$ indicate the center lines of the sheet feeding direction which correspond to the possible sizes (A3, B4, A4 and A4R) of the sheets 29, respectively, and the one-dot chain line $C_2$ indicates the center line of the transverse direction of the sheets 29.

In the sheet size detection device of this embodiment having the foregoing configuration, even when sheets 29 of the same size are used, the variable resistor 50 exhibits different resistance values in cases that the sheets 29 are stacked in different manners (i.e., longitudinal placement and transverse placement). Therefore, even if the resistors 39 and 40 are made of the same material, this device can discriminate between longitudinal placement and transverse placement of the sheets 29 of the same size.

While the invention has been described in terms of preferred embodiments, it should be understood that the invention is not restricted to them and various modifications may be made within the spirit of the invention. For example, the above-described embodiments, employing a so-called center resist system in which the center line of the transverse direction of the cassette body 31 is set as the reference line and the position of the sheets 29 is restricted in the transverse direction by the two transverse guide members 32 disposed on either side of the sheet 29, may be modified so as to employ a so-called side resist system in which one of the two sides of the cassette body 31 is set as the reference line and the position of the sheets 29 is restricted in the transverse direction by one transverse guide member 32. While the embodiments in which the invention is applied to a sheet feeder of a laser beam printer have been described, it is obvious to those skilled in the art that the invention is also applicable to other image forming apparatus such as a copier, or a facsimile apparatus.

As described above, in the sheet size detection device according to the present invention, the first arm which is moved with the first guide member is provided with the first resistor, the second arm is provided with the second resistor, the first and second resistors constitute the variable resistor, and the size of sheets is detected on the basis of the resistance value of the variable resistor. Accordingly, the change of the size of the sheets 29 is output as continuous variation of the resistance value, and the detectable sizes of sheets and the range of its tolerance can be finely set, with the result that it is possible to accurately identify not only sheets of standard sizes but also those of nonstandard sizes, and also to reduce the possibility of malfunction in which the size of sheets is incorrectly detected. Furthermore, even if the number of sizes of sheets which are to be detected is increased, the device can cope with this increased size number without changing the basic structure, and therefore it is not necessary to increase the number of wirings. This allows the manufacturing cost to be lowered, and the reliability of the device to be increased.

Moreover, the sheet size detection device according to the present invention can identify not only sheets of different sizes but also the direction of sheets of the same size.

Particularly, in the sheet size detection device of the invention, the first and second resistors are respectively positioned to be separated from the respective center position of the first and second directions of sheets, thereby producing an effect that the first and second resistors can be made of the same material.

What is claimed is:

1. A sheet size detection device for detecting a size of sheets which are held in a cassette body, comprising:

first guide means for defining a position of said sheets in a first direction of said sheets, said first guide means being movable in accordance with the size of sheets;

second guide means for defining a position of said sheets in a second direction of said sheets, said second direction being orthogonal to said first direction, said second guide means being movable in accordance with the size of sheets;

first arm means having a first resistor movable with said first guide means;

second arm means having a second resistor movable with said second guide means, said first and second resistors constituting a variable resistor whose resistance value changes depending on the position of said first arm and the position of said second arm; and size detection means for detecting the size of said sheets on the basis of the resistance value of said variable resistor.

2. A device as claimed in claim 1, in which said first and second resistors are positioned at the respective center positions of said sheets along said first and second directions, and are respectively made of materials which are different from each other in specific resistance.

3. A device as claimed in claim 1, in which said first and second resistors are respectively positioned at locations which are separated from the respective center positions of said sheets along said first and second directions.

4. A device as claimed in claim 1, wherein said first guide means comprises a pair of transverse guide members which are movable in a transverse direction of said sheets, and opposite to each other, and said first arm means comprises a pair of arms corresponding to said pair of guide members.

5. A device as claimed in claim 4, further comprising a pinion gear positioned on a center line of the transverse direction of the cassette body, wherein said pair of arms have a toothed side to be engaged with said pinion gear, respectively, and a movement of one of said transverse guide members is transmitted through said pinion gear to the other of said transverse guide members to cause said transverse guide members to move in opposite directions.

* * * * *